US006460853B1

(12) United States Patent
Knight

(10) Patent No.: US 6,460,853 B1
(45) Date of Patent: Oct. 8, 2002

(54) METHOD AND GAME SET FOR PLAYING A CHESS-LIKE BOARD GAME

(76) Inventor: Jeffrey J. Knight, 426 Fairgrounds Rd., West Kingston, RI (US) 02892

( * ) Notice: Subject to any disclaimer, the term of this patent is extended or adjusted under 35 U.S.C. 154(b) by 0 days.

(21) Appl. No.: 09/723,814

(22) Filed: Nov. 28, 2000

(51) Int. Cl.[7] ..... A63F 3/00

(52) U.S. Cl. ..... 273/260; 273/262; 273/290; 273/288

(58) Field of Search ..... 273/258, 260, 273/261, 262, 255, 288, 289, 290

(56) References Cited

U.S. PATENT DOCUMENTS 4,200,293 A * 4/1980 Benson
5,197,742 A * 3/1993 Bendit
5,472,208 A * 12/1995 Berry
5,556,099 A * 9/1996 Mardirosian
6,135,452 A * 10/2000 Yurchey

* cited by examiner

*Primary Examiner*—Benjamin H. Layno
*Assistant Examiner*—V K Mendiratta
(74) *Attorney, Agent, or Firm*—Mirick, O'Connell, DeMallie & Lougee, LLP

(57) ABSTRACT

A method of playing a chess-like board game including traditional chess pieces comprising kings, queens, bishops, knights, rooks and pawns, in which pieces can capture one another as in traditional chess, and in which the traditional chess pieces are constrained in their base moves to move as in the traditional chess game, the method comprising: upon capture of an opponent's chess piece with the player's capturing chess piece, allowing the capturing chess piece, in addition to its existing moving capabilities, to assume some, all or none of the moving capabilities of the captured piece, but for only one subsequent move of the capturing chess piece; and after the capturing chess piece has made the assumed subsequent move, removing the assumed moving capabilities.

29 Claims, 3 Drawing Sheets

METHOD AND GAME SET FOR PLAYING A CHESS-LIKE BOARD GAME

FIELD OF THE INVENTION

This invention relates to a modified chess game in which the chess pieces can acquire for one or more subsequent moves, the moves of pieces they capture during the course of the game.

BACKGROUND OF THE INVENTION

In traditional chess, each piece has pre-defined move options. Variations of the game are thus limited. Additionally, these pre-defined move options provide no flexibility for players of different capabilities to play a competitive game. There is also no flexibility in piece move options, which constrains the level of play achievable in a game. Accordingly, there is need for more variety in chess games, and to allow for players of different abilities to play together more competitively.

SUMMARY OF THE INVENTION

This invention features a method of playing a chess-like board game including traditional chess pieces comprising kings, queens, bishops, knights, rooks and pawns, in which pieces can capture one another as in traditional chess, and in which the traditional chess pieces are constrained in their base moves to move as in the traditional chess game. In the traditional chess game, the traditional chess pieces are constrained in what is termed herein their "base" moves to move in a certain well known manner. In this embodiment, the method comprises: providing privilege-defining game pieces adapted to be coupled to and removed from one or more of the traditional chess pieces; upon capture of an opponent's chess piece with the player's capturing chess piece, allowing the capturing piece to assume, in addition to its existing moving capabilities, some, all or none of the moves of the captured piece, but for only one subsequent move of the capturing chess piece; indicating the assumed move capabilities by coupling a privilege defining game piece which identifies the assumed moving capabilities taken from the captured chess piece to the capturing chess piece; and after the capturing chess piece with the coupled privilege-defining game piece has made the assumed subsequent move, uncoupling the coupled privilege-defining game piece from the capturing piece and removing it from play, and by this action returning the capturing piece to its original capability of only its base move, unless the assumed subsequent move resulted in another capture, hence allowing the capturing piece to again assume some, all or none of the moving capabilities of the newly captured piece.

The traditional chess pieces may have a base portion and a more narrow upwardly-projecting portion, wherein the privilege-defining game pieces may fit over the upwardly-projecting portions and come to rest on the base portion of the chess piece. The privilege-defining game pieces are preferably annular. The privilege-defining game pieces may have indicated thereon the move that defines the privilege granted by the piece.

Another means of indicating the assumed moving capabilities would be to provide a separate single game piece which in some manner identifies a dual-move capability. This piece would substituted for the original chess piece for the appropriate amount of time, and would not require the coupling and uncoupling of additional game pieces as discussed above.

The pawn chess piece can preferably accept privilege-defining pieces that define the base moves of at least the following: rook, knight, bishop, and queen. The rook chess pieces can preferably accept privilege-defining pieces that define the base moves of at least the following: pawn, knight, bishop, and queen. The knight chess piece can preferably accept privilege-defining pieces that define the base moves of at last the following: pawn, rook, bishop, and queen. The bishop chess piece can preferably accept privilege-defining pieces that define the base moves of at least the following: pawn, rook, knight, and queen. The queen chess piece can preferably accept privilege-defining pieces that define the base moves of at least the following: knight. The king chess piece can preferably accept privilege-defining pieces that define the base moves of at least the following: rook, knight, bishop, and queen.

Preferably, the capturing chess piece may have coupled to it at any time no more than one privilege-defining game piece, although in variations of the game, more than one can be allowed.

Upon capture of an opponent's chess piece, if both the capturing piece and captured piece are without a coupled privilege-defining game piece, then the capturing chess piece may assume all of the captured piece's moving capabilities (preferably by acquiring and coupling to it a privilege-defining game piece that directly corresponds to the moving capabilities of the base portion of the captured piece), but only if the assumed moving capabilities will expand the moving capabilities of the base portion of the capturing chess piece.

Upon capture of an opponent's chess piece, if the capturing chess piece does not have coupled to it a privilege-defining game piece, and if the captured chess piece has coupled to it a privilege-defining game piece, the capturing chess piece may preferably be allowed to assume the moving capabilities of the base portion of the captured piece (preferably by acquiring and coupling to it a privilege-defining game piece that directly corresponds to the moving capabilities of the base portion of the captured piece), or to take from the captured chess piece its privilege-defining game piece and couple it to the capturing chess piece and thereby assume the moving capabilities as defined by the privilege-defining game piece of the captured chess piece, but only if either of the assumed moves will expand the moving capabilities of the base portion of the capturing chess piece.

Preferably, if a capturing chess piece with a coupled privilege-defining game piece moves and captures an opposing chess piece based upon the authority given it from its base, the capturing piece may not assume any moving capabilities from the captured piece.

If a capturing chess piece with a coupled privilege-defining game piece moves and captures an opposing chess piece based upon the authority given it from its acquired privilege-defining game piece, it must first immediately uncouple and remove from play its just used privilege-defining game piece and then it may preferably be allowed to assume the moving capabilities of the base portion of the captured piece(preferably by acquiring and coupling to it a new privilege-defining game piece that directly corresponds to the moving capabilities of the base portion of the captured piece), or, if applicable, may immediately acquire and couple to it the captured piece's privilege-defining game piece, and hence assume the moving capabilities as defined by the privilege-defining game piece of the captured chess piece, but only if either of the assumed moves will expand the moving capabilities of the base portion of the capturing chess piece.

In another embodiment, this invention features a method of playing a chess-like board game including traditional chess pieces comprising kings, queens, bishops, knights, rooks and pawns, in which pieces can capture one another as in traditional chess, and in which the traditional chess pieces are constrained in their base moves to move as in the traditional chess game, the method comprising: upon capture of an opponent's chess piece with the player's capturing chess piece, allowing the capturing chess piece to assume, in addition to its existing moving capabilities, some, all or none of the moving capabilities of the captured piece, but for only one subsequent move of the capturing chess piece; and after the capturing chess piece has made the assumed subsequent move, withdrawing the assumed moving capabilities, unless the assumed subsequent move resulted in another capture, hence allowing the capturing piece to again assume some, all or none of the moving capabilities of the newly captured piece.

In this embodiment, the pawn chess piece can preferably assume the base moves of at least the following: rook, knight, bishop, and queen, the rook chess pieces can preferably assume the base moves of at least the following: pawn, knight, bishop, and queen, the knight chess piece can preferably assume the base moves of at last the following: pawn, rook, bishop, and queen, the bishop chess piece can preferably assume the base moves of at least the following: pawn, rook, knight, and queen, the queen chess piece can preferably assume the base move of at least the following: knight, and the king chess piece can preferably assume the base moves of at least the following: rook, knight, bishop, and queen.

Upon capture of an opponent's chess piece, if both the capturing piece and captured piece are without any assumed move capabilities, then the capturing chess piece may assume all of the captured piece's moving capabilities (preferably by acquiring a privilege-defining game piece that directly corresponds to the moving capabilities of the base portion of the captured piece), but only if the assumed moving capabilities will expand the moving capabilities of the base portion of the capturing chess piece.

Upon capture of an opponent's chess piece, if the capturing chess piece does not have any assumed moving capabilities, and if the captured chess piece does have assumed moving capabilities, the capturing chess piece may preferably be allowed to assume the moving capabilities of the base portion of the captured piece (preferably by acquiring a privilege-defining game piece that directly corresponds to the moving capabilities of the base portion of the captured piece), or to take from the captured chess piece its assumed moving capabilities (preferably by acquiring from the captured chess piece its privilege-defining game piece and thereby assume the moving capabilities as defined by the privilege-defining game piece of the captured chess piece), but only if either of the assumed moves will expand the moving capabilities of the base portion of the capturing chess piece.

Preferably, if a capturing chess piece with assumed moving capabilities moves and captures an opposing chess piece based upon the authority given it from its base, the capturing piece may not assume any moving capabilities from the captured piece.

If a capturing chess piece with assumed moving capabilities moves and captures an opposing chess piece based upon the authority given it from its assumed moving capabilities, it may preferably be allowed to assume the moving capabilities of the base portion of the captured piece (preferably by acquiring a privilege-defining game piece that directly corresponds to the moving capabilities of the base portion of the captured piece), or, if applicable, may acquire the captured piece's assumed moving capabilities (preferably by acquiring from the captured chess piece its privilege-defining game piece, and hence assume the moving capabilities as defined by the privilege-defining game piece of the captured chess piece), but only if either of the assumed moves will expand the moving capabilities of the base portion of the capturing chess piece.

In another embodiment, this invention features a set of playing pieces for a chess-like board game, comprising: traditional chess pieces comprising kings, queens, bishops, knights, rooks and pawns; and privilege-defining game pieces adapted to be coupled to and removed from one or more of the traditional chess pieces, each said privilege defining game piece defining on its face the base move of a traditional chess piece, including the base moves of a pawn, rook, knight, bishop, and queen. The set of playing pieces may further include a privilege-defining game piece that defines the base moves of a traditional king.

BRIEF DESCRIPTION OF THE DRAWINGS

Other objects, features, and advantages will occur to those skilled in the art from the following description of the preferred embodiment, and the accompanying drawings, in which.

DESCRIPTION OF THE PREFERRED EMBODIMENTS

This invention may be accomplished in a method of playing a chess-like board game, and a game piece set for playing this board game. The term "board game" as used herein is meant to encompass not only a traditional board game with a physical board, but also electronic versions thereof that are popular today, accessed via the Internet, personal computers, hand held electronic game consoles, and the like, in which the board is a graphic appearing on the graphic display. All the descriptions and claims herein are meant to encompass both a physical and electronic version of the game. In the game, there are traditional chess pieces comprising kings, queens, bishops, knights, rooks and pawns. In the electronic version, of course, these pieces are simply displays. The game of this invention augments the traditional chess game, in which the chess pieces can capture one another as is well know.

In this invention, when a player captures an opponents' chess piece with a player's capturing chess piece, preferably the capturing chess piece can assume, in addition to its existing moving capabilities, some, all or none of the moving capabilities of the captured piece, but preferably these assumed added moving capabilities can be used for only one subsequent move of the capturing piece. After the capturing piece has made the assumed added move, it no longer has this expanded moving capability and its move options are returned back to its original capability of only its base move. If however the assumed subsequent move resulted in a capture, the capturing piece, of course, can immediately assume some, all or none of the moving capabilities of the newly captured piece.

In the preferred embodiment of the method of this invention, a capturing chess piece can assume additional moving capabilities only if these assumed additional moving capabilities will expand the overall moving ability of the base of the capturing chess piece. Thus, the pawn is allowed to assume the additional moves of a rook, knight, bishop, and queen. The rook is thus allowed to assume the additional moves of a pawn, knight, bishop and queen. The knight is thus allowed to assume the additional moves of a pawn, rook, bishop and queen. The bishop is allowed to assume the additional moves of a pawn, rook, knight and queen. The queen is allowed to assume the additional moves only of a knight. The king is allowed to assume the additional moves of a rook, knight, bishop and queen. Additionally, in one alternative embodiment of this game in which each player can play with two kings, the pawn, rook, knight and bishop are also allowed to assume the additional moves of a king.

Figure 1:
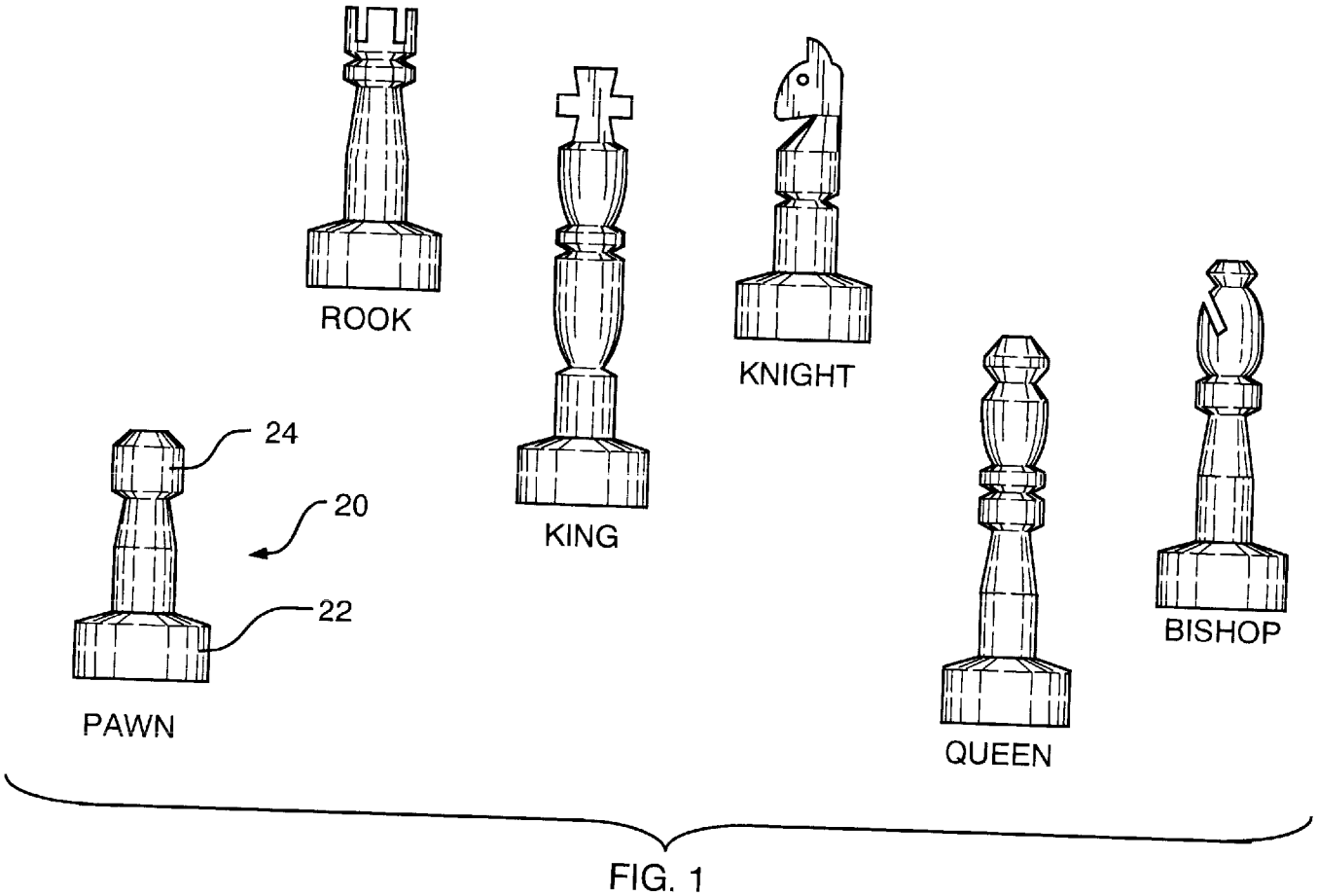
FIG. 1 are side views of the traditional chess pieces for use in this invention.

An embodiment of traditional chess pieces which can be used in the physical embodiment of this invention are shown in FIG. 1. These chess pieces have a base and a more narrow upwardly-projecting portion projecting from the base. For example, pawn 20, FIG. 1, has cylindrical, square, rectangular or another shaped base 22 with more narrow projecting portion 24 having the traditional shape for that piece. As can be seen, the other traditional pieces are similarly constructed so that the base which sits on the board is wider than the projecting portion.

Figure 3:
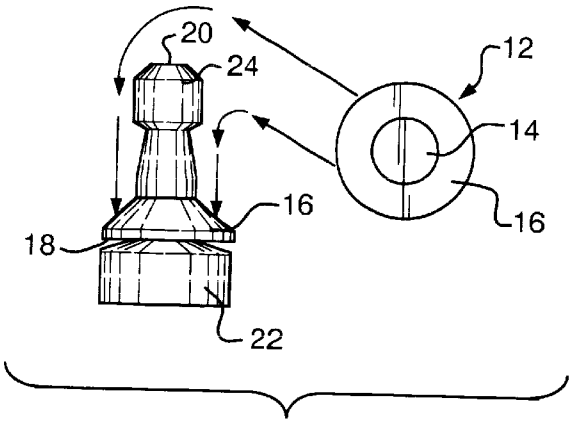
FIG. 3 is a view of the manner in which the privilege-defining game piece of FIG. 2 is placed over a chess piece of FIG. 1.
Figure 2B:
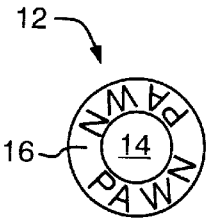
FIG. 2B is a top view of the privilege-defining game piece of FIG. 2A also showing the writing thereon.
Figure 2A:
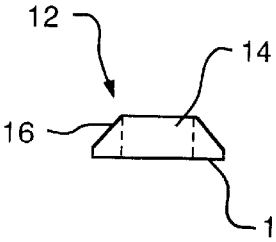
FIG. 2A is a side view (with the writing removed for clarity) of a preferred embodiment of the privilege-defining game piece for this invention.
Figure 4:
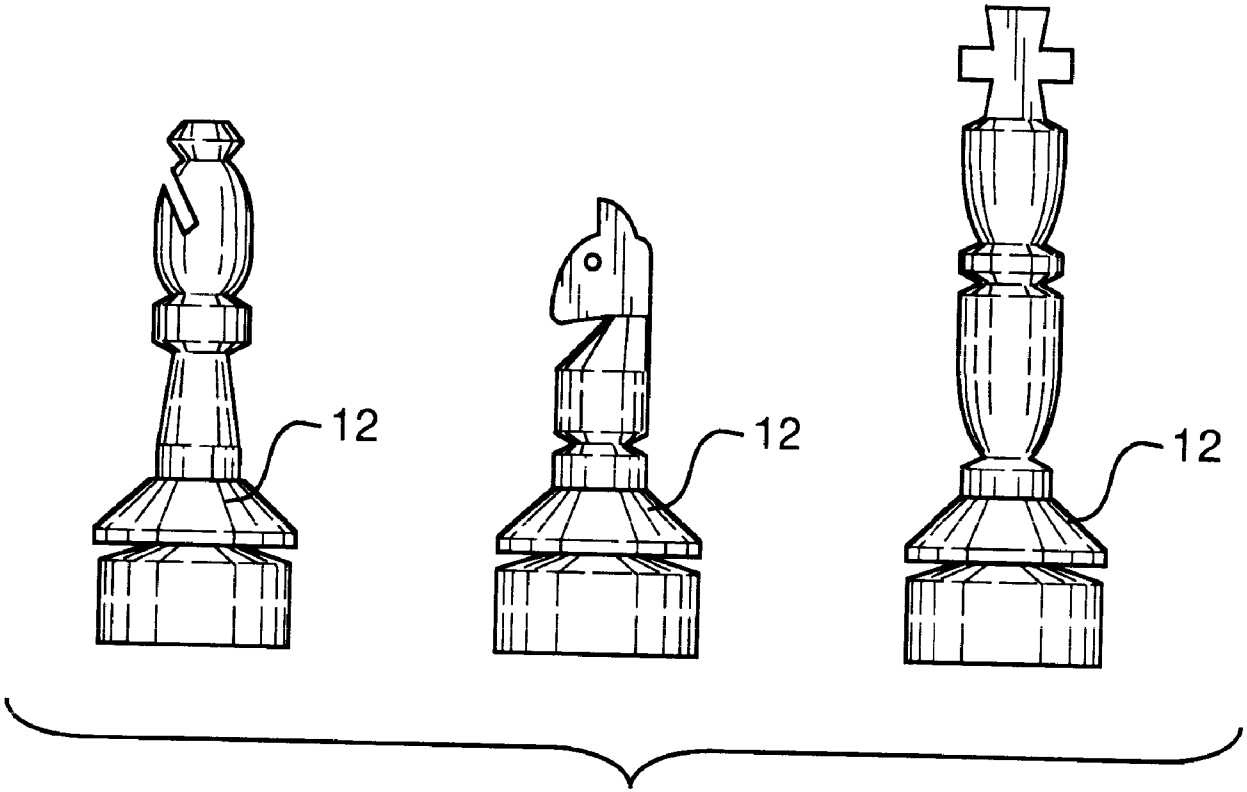
FIG. 4 is a side view of a number of chess pieces of FIG. 1 carrying privilege-defining game pieces of the type shown in FIG. 2.

This invention is meant to encompass any potential means of indicating on the chess pieces the captured moving capability of a piece captured by a capturing piece. In the preferred embodiment, this is accomplished by providing privilege-defining game pieces such as game piece 12, FIG. 2A, that are adapted to be coupled to and removed from the traditional chess pieces. Game piece 12 is preferably generally annular, with some means for carrying/displaying/indicating an indication of the base move of a captured piece that it provides to the capturing piece. In the embodiment shown in FIGS. 2A and 2B, this is accomplished by providing sloped face 16 upon which is written or indicated the captured piece, thus defining the base move of the captured piece that is captured by the capturing piece. FIG. 2B shows a privilege-defining game piece 12 indicating the base move of a captured pawn. Piece 12 has opening 14 which is larger than the diameter of the upwardly projecting portions 24 of the traditional chess pieces so that piece 12 can fit over these upwardly projecting portions such that its base 18 can sit on the top of base 22, as shown in FIG. 3. The writing or other indication on the privilege-defining game piece is thus immediately apparent to both players. FIG. 4 depicts a number of traditional chess pieces with these privilege-defining game pieces fitted thereon.

Other means of indicating an assumed (captured) move are also contemplated herein. Such means can comprise any piece or pieces that can be removably coupled to the chess piece to indicate the captured move. These could be paper or tape pieces or vests with visible indicia thereon, or colored pieces, or pieces of different shape, or any other such means. Alternatively, this could be accomplished with separate pieces that replace the traditional chess piece, and by some means (such as symbols or shapes or writing) indicate that they carry the moving capabilities of two different traditional chess pieces.

In the electronic version, many more potential indicating means are possible. For example, the icon of the traditional chess piece could have overlaid thereon the name or symbol of the captured chess piece. Or, the appearance of a removable mechanical member could be created on the display so that the electronic version mimics the physical game board version.

In the preferred embodiment of the game of the invention, when any piece is captured by a capturing piece, the base portion of the capturing piece may, in the appropriate circumstances, expand its moving capabilities by acquiring and coupling to it a privilege-defining game piece that directly corresponds to some or all of the moving capabilities of the captured piece, but only if such would expand the moving capabilities of the base portion of the capturing piece. This captured expanded move capability can then be used only once on a subsequent move to whatever benefit it may provide to the capturing piece, such as a move that further results in capturing another opposing piece, or a move that provides escape from an opposing threat, or simply a move to reposition the chess piece elsewhere on the board. Once this special captured move is used, the capturing pieces loses its ability to move in this expanded manner. This is indicated in the physical version by the removal of the privilege-defining game piece from the capturing chess piece, which now frees-up the capturing chess piece to subsequently capture another privilege-defining game piece. The player need not use the captured move on the next move of the capturing piece, and can save the captured move for use anytime.

If a capturing piece does not have expanded moving capabilities (which would be evident to the players because the base of the capturing chess piece would not have coupled to it a privilege-defining game piece), and it captures an opposing piece that also does not have expanded moving capabilities, then the capturing piece has the option to acquire and couple to it a privilege-defining game piece that transfers to the capturing base piece the additional moving capabilities of the captured piece, but only if the assumed moving capabilities will expand the moving capabilities of the base of the capturing piece. On the other hand, if the captured piece does have expanded moving capabilities as indicated by a privilege-defining game piece coupled to it, then the capturing piece has the option to either acquire and couple to it the privilege-defining game piece from the captured piece and thus assume the moving capabilities as defined by the privilege-defining game piece, or to acquire and couple to it a privilege-defining game piece that corresponds to the moving capabilities of the base portion of the captured piece, and thus assume the base moving capabilities of the captured piece, but only if either choice expands the moving capabilities of the base of the capturing piece.

Once a base piece has expanded moving capabilities as indicated by being coupled with a privilege-defining game piece, it may not assume any other move capabilities until it has used the expanded moving capability as indicated by the privilege-defining game piece, and the coupled privilege-defining game piece has been uncoupled and removed from play. Thus, if a capturing piece already has expanded moving capabilities, and captures another piece by use of the authority given it from its base, as opposed to the authority given it from its acquired privilege-defining game piece, then the capturing piece cannot assume any moving capabilities from the captured piece. On the other hand, if the capturing move is made by use of the authority given it from its acquired privilege-defining game piece, then the privilege-defining game piece is uncoupled and removed from the base portion of the capturing piece and thus retired from play, and the base portion of the capturing chess piece may then immediately assume either the moving capabilities of the base portion of the captured piece, or, if applicable, the moving capabilities of the privilege-defining game piece carried by the captured piece, but, of course, only if either choice expands the moving capabilities of the capturing base piece.

Preferably, the game is designed so that each player, before completing a capturing move, must verbally indicate to his or her opponent which, if any, of the moves will be assumed by the capturing piece from the captured piece. If the player does not make a declaration before the end of the capturing move, all move capturing rights are forfeited for that turn. Obviously, in the electronic version that can be played remotely, such declaration or indication would have to be made using the keyboard or another equivalent means.

The game of this invention is otherwise played like a traditional chess game, and ends in the same manner as a traditional chess game.

In one version of the game, each player may have two kings, in which case a player must capture both opposing kings to claim victory. This is done by capturing the opponent's first king just as would any other of the opposer's playing pieces, removing the captured king from the board, and then pursuing and checkmating the second and sole remaining king.

In another variation of the game of this invention, each player may be allowed to move or trade their captured privilege-defining game pieces between their other base game pieces. In another variation, base game pieces can be allowed to carry more than one privilege-defining game piece at a time, hence allowing the base game pieces to assume the moving capabilities of more than one traditional opposing player's pieces at any point in time. In yet another variation, some or all of each player's base game pieces may start the game coupled with one or more privilege-defining game pieces. Or, players may be allowed to begin the game with more or less than the traditional number of (16) starting chess pieces.

In a situation where two competing players are at different skill levels and they wish to make the game more competitive, the players may choose to play yet another variation of this game, where the more experienced player will voluntarily forfeit his or her right to acquire moving capabilities by reason of the capture of opposing pieces, while the less experienced player retains the right to acquire expanded moving capabilities. This situation would preferably be the case throughout the entire game.

The invention described herein may also be employed with alternative chess playing boards in use, that allow up to four players to play simultaneously. The invention is applicable in any game in which two or more players compete. This can be accommodated by having different colored chess pieces and special pieces described above under this invention.

Although specific features of this invention are shown in some drawings and not others, this is for convenience only as each feature may be combined with any or all of the other features in accordance with the invention.

Other embodiments will occur to those skilled in the art and are within the following claims.

What is claimed is:

1. A method of playing a chess-like board game including traditional chess pieces comprising kings, queens, bishops, knights, rooks and pawns, in which a player's capturing chess piece can capture an opponent's piece, which then becomes a captured piece, as in traditional chess, and in which the traditional chess pieces are constrained in their base moves to move as in the traditional chess game, the method comprising:

providing privilege-defining game pieces adapted to be coupled to and removed from one or more of the traditional chess pieces;

upon capture of an opponent's chess piece with the player's capturing chess piece, allowing the capturing chess piece, in addition to its existing moving capabilities, to assume some, all or none of the moving capabilities of the captured piece, but for only one subsequent move of the capturing chess piece;

indicating the assumed moving capabilities by coupling a privilege-defining game piece that corresponds to the moving capabilities assumed from the just captured chess piece to the capturing chess piece; and after the capturing chess piece with the coupled privilege-defining game piece has made the assumed subsequent move, uncoupling the coupled privilege-defining game piece from the capturing piece and removing it from play, and by this action withdrawing the assumed moving capabilities.

2. The game-playing method of claim 1 wherein the traditional chess pieces have a base and a more narrow upwardly-projecting portion, wherein the privilege-defining game pieces fit over the upwardly-projecting portions.

3. The game-playing method of claim 2 wherein the privilege-defining game pieces are annular.

4. The game-playing method of claim 1 wherein the privilege-defining game pieces have indicated thereon the move that defines the privilege granted by the piece.

5. The game-playing method of claim 1 wherein the pawn chess piece can accept privilege-defining pieces that define and impart the base moves of at least the following: rook, knight, bishop, and queen, to expand the moving capabilities of the pawn.

6. The game-playing method of claim 1 wherein the rook chess pieces can accept privilege-defining pieces that define and impart the base moves of at least the following: pawn, knight, bishop, and queen, to expand the moving capabilities of the rook.

7. The game-playing method of claim 1 wherein the knight chess piece can accept privilege-defining pieces that define and impart the base moves of at last the following: pawn, rook, bishop, and queen, to expand the moving capabilities of the knight.

8. The game-playing method of claim 1 wherein the bishop chess piece can accept privilege-defining pieces that define and impart the base moves of at least the following: pawn, rook, knight, and queen, to expand the moving capabilities of the bishop.

9. The game-playing method of claim 1 wherein the queen chess piece can accept privilege-defining pieces that define and impart the base moves of at least the following: knight, to expand the moving capabilities of the queen.

10. The game-playing method of claim 1 wherein the king chess piece can accept privilege-defining pieces that define and impart the base moves of at least the following: rook, knight, bishop, and queen, to expand the moving capabilities of the king.

11. The game-playing method of claim 1 wherein a capturing chess piece may have coupled to it at any time no more than one privilege-defining game piece.

12. The game-playing method of claim 1, wherein, upon capture of an opponent's chess piece, if the capturing and captured pieces are each without a coupled privilege-defining game piece, then the capturing piece may acquire and couple to it a privilege-defining game piece that corresponds to the moving capabilities of the base portion of the captured piece, and thus assume all of the moving capabilities of the captured piece, but only if the assumed moving capabilities expands the moving capabilities of the base portion of the capturing chess piece.

13. The game-playing method of claim 1, wherein, upon capture of an opponent's chess piece, if the capturing piece is without a coupled privilege-defining game piece, and the captured piece has coupled to it a privilege-defining game piece, then the capturing piece may acquire and couple to it a privilege-defining game piece that corresponds to the moving capabilities of the base portion of the captured piece, and thus assume some of the moving capabilities of the captured piece, but only if the assumed moving capabilities expands the moving capabilities of the base portion of the capturing chess piece.

14. The game-playing method of claim 1, wherein, upon capture of an opponent's chess piece, if the capturing piece is without a coupled privilege-defining game piece, and the captured piece has coupled to it a privilege-defining game piece, then the capturing piece may acquire and couple to it the privilege-defining game piece from the captured piece, and thus assume some of the moving capabilities of the captured piece as defined by the captured privilege-defining game piece, but only if the assumed moving capabilities expands the moving capabilities of the base portion of the capturing chess piece.

15. The game-playing method of claim 1, wherein, upon capture of an opponent's chess piece, if the capturing piece has coupled to it a privilege-defining game piece, and the capturing move is made by the authority of its base, then the capturing piece may not acquire and couple to it a privilege-defining game piece and thus may not assume any of the moving capabilities of the captured piece.

16. The game-playing method of claim 1, wherein, upon capture of an opponent's chess piece, if the capturing and captured pieces each have coupled to them a privilege-defining game piece, and the capturing move is made by authority of the privilege-defining game piece, then the base portion of the capturing piece must uncouple and remove from play its privilege-defining game piece, and may immediately acquire and couple to it a new privilege-defining game piece that corresponds to the moving capabilities of the base portion of the captured piece, and thus assume some of the moving capabilities of the captured piece, but only if the assumed moving capabilities expands the moving capabilities of the base portion of the capturing chess piece.

17. The game-playing method of claim 1′, wherein, upon capture of an opponent's chess piece, if the capturing and captured pieces each have coupled to them a privilege-defining game piece, and the capturing move is made by authority of the privilege-defining game piece, then the base portion of the capturing piece must uncouple and remove from play its privilege-defining game piece, and may immediately acquire and couple to it the privilege-defining game piece from the captured piece, and thus assume some of the moving capabilities of the captured piece as defined by the captured privilege-defining game piece, but only if the assumed moving capabilities expands the moving capabilities of the base portion of the capturing chess piece.

18. The game-playing method of claim 1, wherein, upon capture of an opponent's chess piece, if the capturing piece has coupled to it a privilege-defining game piece but the captured piece does not, and the capturing move is made by authority of the privilege-defining game piece, then the base portion of the capturing piece must uncouple and remove from play its privilege-defining game piece, and may immediately acquire and couple to it a new privilege-defining game piece that corresponds to the moving capabilities of the base portion of the captured piece, and thus assume all of the moving capabilities of the captured piece, but only if the assumed moving capabilities increases the moving capabilities of the base portion of the capturing chess piece.

19. The game playing method of claim 1, wherein the capturing chess piece can assume additional moving capabilities only if such will expand the moving capabilities of the capturing chess piece.

20. The game playing method of claim 1 wherein, if a capturing chess piece with a coupled privilege-defining piece captures a captured piece as a result of its base move, the capturing piece may not assume any additional moving capabilities from the captured piece.

21. A method of playing a chess-like board game including traditional chess pieces comprising kings, queens, bishops, knights, rooks and pawns, in which a player's capturing chess piece can capture an opponent's piece, which then becomes a captured piece, as in traditional chess, and in which the traditional chess pieces are constrained in their base moves to move as in the traditional chess game, the method comprising:

upon capture of an opponent's chess piece with the player's capturing chess piece, allowing the capturing chess piece, in addition to its existing moving capabilities, to assume some, all or none on the moving capabilities of the captured piece, but for only one subsequent move of the capturing chess piece; and after the capturing chess piece has made the assumed subsequent move, withdrawing the assumed moving capabilities.

22. The game-playing method of claim 21 wherein the pawn chess piece can assume the base moves of at least the following: rook, knight, bishop, and queen, to expand the moving capabilities of the pawn.

23. The game-playing method of claim 21 wherein the rook chess pieces can assume the base moves of at least the following: pawn, knight, bishop, and queen, to expand the moving capabilities of the rook.

24. The game-playing method of claim 21 wherein the knight chess piece can assume the base moves of at last the following: pawn, rook, bishop, and queen, to expand the moving capabilities of the knight.

25. The game-playing method of claim 21 wherein the bishop chess piece can assume the base moves of at least the following: pawn, rook, knight, and queen, to expand the moving capabilities of the bishop.

26. The game-playing method of claim 21 wherein the queen chess piece can assume the base moves of at least the following: knight, to expand the moving capabilities of the queen.

27. The game-playing method of claim 21 wherein the king chess piece can assume the base moves of at least the following: rook, knight, bishop, and queen, to expand the moving capabilities of the king.

28. The game playing method of claim 21, wherein the capturing chess piece can assume additional moving capabilities only if the assumed moving capabilities will expand the moving capabilities of the capturing chess piece.

29. The game playing method of claim 21 wherein, if a capturing chess piece with an assumed move from a previously-captured piece captures a captured piece as a result of its base move, the capturing piece may not assume any additional moving capabilities of the captured piece.

* * * * *